US005881684A

United States Patent [19]

Bontaz

[11] Patent Number: 5,881,684

[45] Date of Patent: Mar. 16, 1999

[54] INTERFERENCE FIT COOLING SPRAY NOZZLE

[75] Inventor: Yves Bontaz, Marnaz, France

[73] Assignee: Bontaz Centre, Societe Anonyme, Marnaz, France

[21] Appl. No.: 900,393

[22] Filed: Jul. 21, 1997

[51] Int. Cl.[6] ..... F01P 1/04

[52] U.S. Cl. ..... 123/41.35; 239/600

[58] Field of Search ..... 123/41.35; 239/589, 239/597, 600

[56] References Cited

U.S. PATENT DOCUMENTS

| | | | |
|---|---|---|---|
| 2,991,769 | 7/1961 | Chapin . | |
| 3,709,109 | 1/1973 | Howe | 123/41.35 |
| 4,979,473 | 12/1990 | Lee | 123/41.35 |
| 4,995,346 | 2/1991 | Hudson, Jr. | 123/41.35 |
| 5,503,116 | 4/1996 | Wolf | 123/41.35 |

FOREIGN PATENT DOCUMENTS

| | | |
|---|---|---|
| 2 259 981 | 8/1975 | France . |
| A-1957499 | 5/1971 | Germany . |
| A-2532132 | 2/1977 | Germany . |
| A-3416076 | 1/1985 | Germany . |

*Primary Examiner*—Weilun Lo
*Attorney, Agent, or Firm*—Ratner & Prestia

[57] ABSTRACT

A spray nozzle comprises a spray nozzle body through which there run an axial passage and a transverse bore to which a cooling fluid outlet injection conduit is connected. The spray nozzle body further comprises a sleeve in the shape of a cylinder of revolution coaxial with the axial passage. The outside diameter of the sleeve is such that it can be force-fitted into the fluid feed orifice of the cylinder, which is also a cylinder of revolution. The outside surface of the sleeve has a smooth or knurled portion. The spray nozzle is simply force-fitted into the cooling fluid feed orifice.

6 Claims, 2 Drawing Sheets

INTERFERENCE FIT COOLING SPRAY NOZZLE

BACKGROUND OF THE INVENTION

1. Field of the Invention

Piston cooling spray nozzles for internal combustion engines are used to spray a cooling fluid such as oil onto the back of the piston, i.e. onto the face of the piston outside the combustion chamber, or into a piston tunnel.

2. Description of the Prior Art

The piston cooling spray nozzles usually employed are separate parts fixed to the engine block and communicating with a cooling fluid feed orifice. The position of the spray nozzle must be precisely determined to determine precisely the point of impact of the jet of cooling fluid on the back of the piston or in the piston tunnel.

One technique known in itself, described for example in document DE-A-19 57 499, consists in providing a one-piece spray nozzle body limited by a bearing face and by an opposite fixing face, provided with an axial bore through which a fixing and fluid feed screw-valve extend. The axial bore communicates with a transverse bore connected to a cooling fluid outlet injection conduit. The screw-valve is shaped and adapted to hold the spray nozzle body with its bearing face pressed against the peripheral area of a fluid feed orifice in the engine block wall and to transmit the cooling fluid to the inlet of the transverse bore. The screw-valve screws into a screwthreaded end portion of a cooling passage discharging through the fluid feed orifice. Centering and rotation preventing means are used to position the spray nozzle body in the engine cylinder. In the above document, these centering and immobilizing means comprise a ball engaged in corresponding housings in the engine block and the spray nozzle body.

A one-piece cooling spray nozzle body of this kind is made of metal and can be machined from a block of metal or cast and machined. In all cases, it is a part of complex shape and therefore has a high production cost. Moreover, the necessary clearance between the screw-valve and the screwthreaded bore in the engine block which receives it introduces uncertainty as to the final position of the spray nozzle and the position at which the jet of cooling fluid impacts on the back of the piston. Furthermore, the centering and rotation preventing means significantly increase the volume and the manufacturing cost of the spray nozzle.

Furthermore, defective seals have been found between the spray nozzle body and the engine block wall with the result that some of the cooling fluid escapes directly between the spray nozzle body and the engine block wall and does not reach the piston Other complex shapes of one-piece spray nozzle body are described in the documents U.S. Pat. No. 2,991,769 and U.S. Pat. No. 4,010,718.

Document DE-A-34 16 076 discloses a piston cooling spray nozzle in which the spray nozzle body is held by a fixing plate fixed by screws passing through two holes in the plate. The fixing plate has a central excrescence penetrating to the interior of the spray nozzle body. This mode of fixing is very different from a screw-valve and necessitates additional machining in the engine block wall.

The problem addressed by the present invention is that of designing a new screw-valve type spray nozzle structure for piston cooling that can be manufactured at significantly less cost than the structures known in themselves, that provides all the centering and rotation preventing functions required for precise positioning of the spray nozzle in the engine cylinder, and which enhances the orientation precision and reproducibility with which the jet of cooling fluid is sprayed onto the back of the piston.

The present invention is the result of the observation that the piston cooling spray nozzle body has a complex shape adapted to provide multiple functions: some shape parts are designed to center and prevent rotation of the spray nozzle body in the engine cylinder; other shape parts are designed to conduct the cooling fluid and to provide a seal between the spray nozzle body and the engine block wall as well as forming and directing the jet of cooling fluid. The idea is to have the parts of the spray nozzle assuring the fluid conduction and sealing functions also assure the centering and rotation prevention functions.

SUMMARY OF THE INVENTION

To this end, a spray nozzle for cooling internal combustion engine pistons comprises a spray nozzle body with an axial passage through it communicating with a transverse bore connected to a cooling fluid outlet injection conduit, said spray nozzle body being shaped so that it can be fixed to the cylinder wall and establish sealed communication between said axial passage and a fluid feed orifice for introducing said cooling fluid into said spray nozzle, with centering and rotation preventing means for positioning said spray nozzle body in a cylinder of the engine; said spray nozzle body comprises a sleeve in the shape of a cylinder of revolution coaxial with said axial passage, the outside diameter of said sleeve being such that it can be force-fitted into said fluid feed orifice which is itself a cylinder of revolution; said cooling fluid outlet injection conduit has two opposed lateral reference faces shaped to constitute reference faces that can cooperate with locating abutments both during bending of said conduit and during fitting of said spray nozzle into said engine.

Unexpectedly, it has been found that a simplified spray nozzle fixing structure of this kind assures effective fastening of the spray nozzle in the cylinder and enhances the precision of positioning.

In one advantageous embodiment the external surface of the sleeve has a knurled portion with straight or criss-cross knurling.

Nevertheless it is still effective, and less costly, for the external surface of the sleeve to be smooth.

In all cases, it can be advantageous to provide at the base of the external surface of the sleeve a groove limiting the length of the sleeve interengaged with the wall of the fluid feed orifice. This controls the force necessary for inserting and extracting the spray nozzle.

Other objects, features and advantages of the present invention will emerge from the following description of a specific embodiment given with reference to the accompanying drawings.

DETAILED DESCRIPTION OF THE PREFERRED EMBODIMENT

Figure 4:
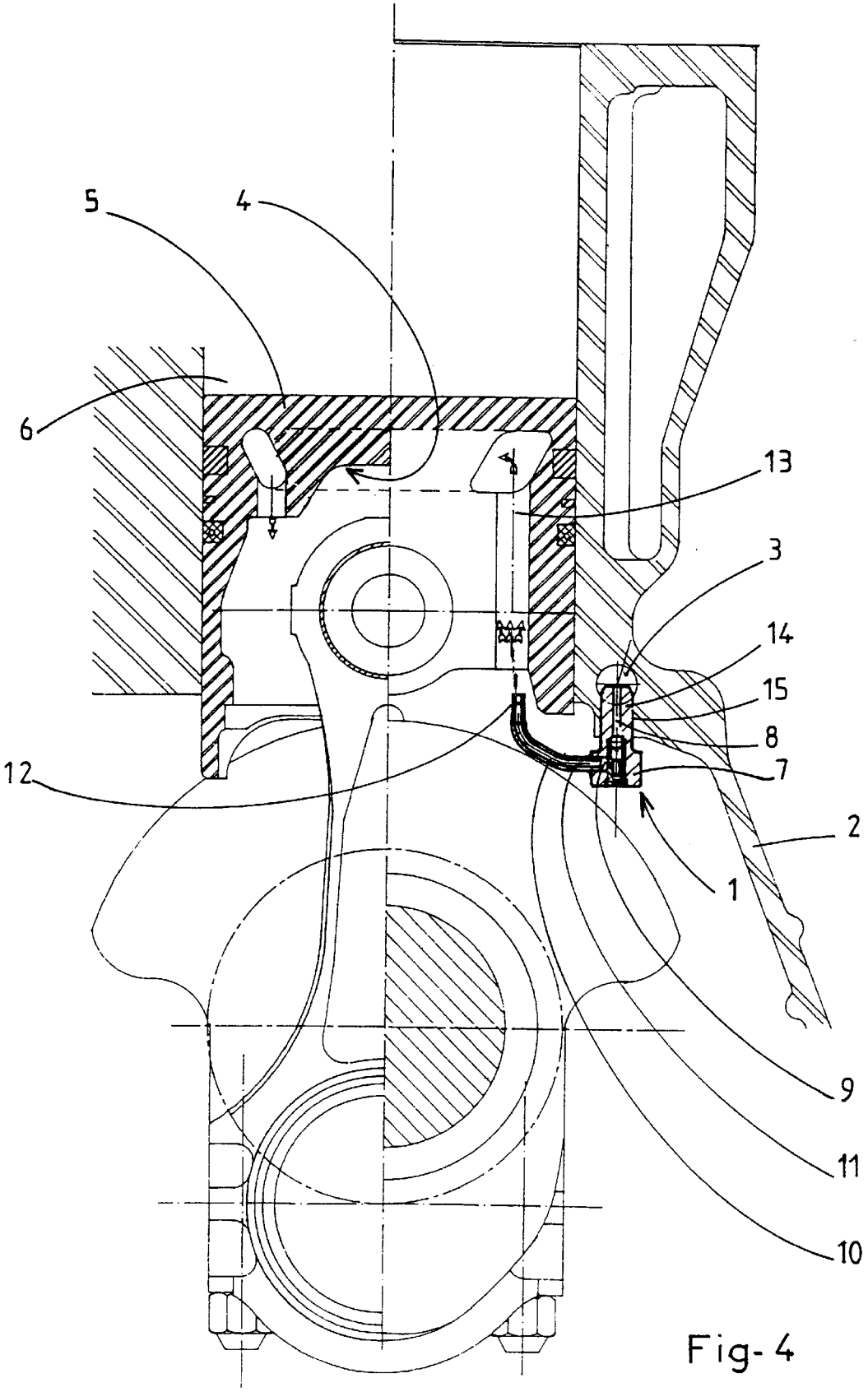
FIG. 4 is a fragmentary sectional elevation view showing a cooling spray nozzle of the invention associated with an engine cylinder with a particular embodiment of the piston.

In the embodiment shown in FIG. 4, a piston cooling spray nozzle 1 is a separate part attached to the cylinder wall 2, inside the engine, shaped to take up cooling fluid flowing in a cooling passage 3 and to spray the cooling fluid into the engine cylinder against the back 4 of the piston 5, i.e. against the face of the piston that is outside the combustion chamber 6.

The spray nozzle 1 comprises a spray nozzle body 7 with an axial passage 8 through it communicating with a transverse bore 9 connected to a cooling fluid outlet injection conduit 10.

The cooling fluid outlet injection conduit 10 is a curved tube one end 11 of which is fastened into the transverse bore 9 in the spray nozzle body 7 and the other end 12 of which is directed towards the piston 5.

In FIG. 4, the piston 5 is shown in the bottom dead center position and the jet of cooling fluid is shown by the chain-dotted line 13. The benefit of precise orientation and concentration of the jet 13 of cooling fluid, so that it impinges on the piston 5 in an appropriate area promoting the distribution of the cooling fluid over the back 4 of the piston, regardless of the position of the piston 5 along its travel, is evident.

This makes it necessary to provide means for centering and preventing rotation of the spray nozzle body 7 on the cylinder wall 2.

Figure 1:
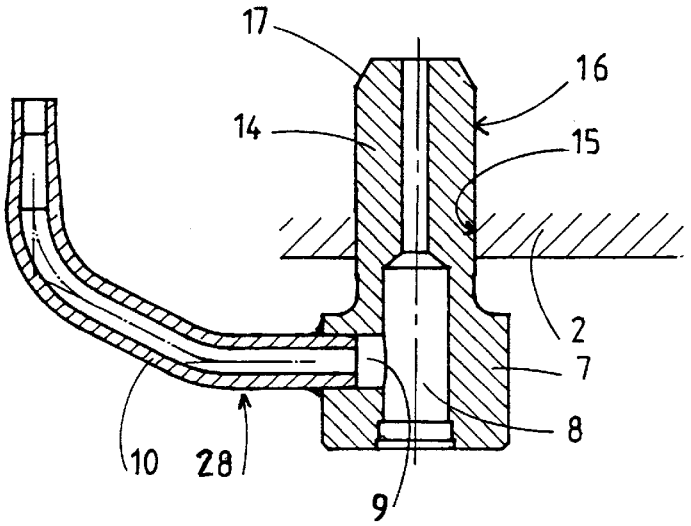
FIG. 1 is a sectional front elevation view showing one embodiment of a cooling spray nozzle of the invention.
Figure 2:
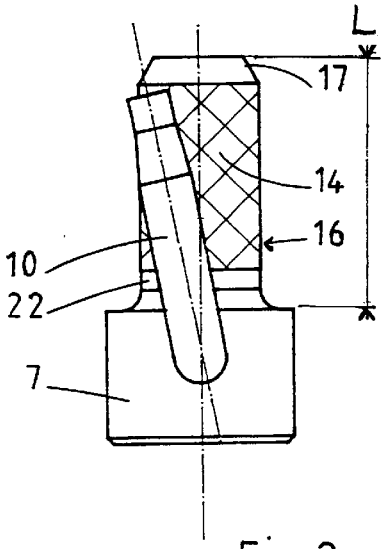
FIG. 2 is a right side view of the spray nozzle from FIG. 1.
Figure 3:
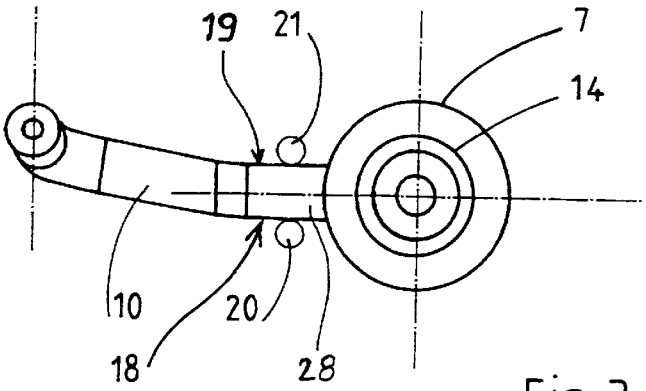
FIG. 3 is a plan view of the spray nozzle from FIG. 1.

FIGS. 1 through 3 shows the spray nozzle 1 from FIG. 4 to a larger scale. In accordance with the invention, the correct positioning of the spray nozzle 1 and of the jet 13 are assured by using the cooling fluid outlet injection conduit 10 itself as the reference. To this end, the cooling fluid outlet injection conduit 10 has two opposite lateral reference faces 18 and 19, see FIG. 3, constituted by the lateral faces of a rectilinear portion 28 of the conduit 10 shaped appropriately to constitute reference faces. These lateral reference faces 18, 19 can cooperate with locating abutments 20 and 21 of a fitting tool both during the bending of the conduit 10 during its manufacture and during fitting of the spray nozzle 1 into the engine. The location abutments 20 and 21 bear against the lateral reference faces 18 and 19 at the outlet of the conduit 10, leaving a minimum clearance. This enhances the reproducibility of the point of impact of the jet 13.

In accordance with the invention, as shown in more detail in FIGS. 1 through 4, the spray nozzle body 7 comprises a sleeve 14 in the shape of a cylinder of revolution coaxial with the axial passage 8. The outside diameter of the sleeve 14 is such that it can be forcefitted into the fluid feed orifice 15 in the cylinder wall 2. The fluid feed orifice 15 is itself a cylinder of revolution.

In the embodiment shown, the outside surface of the sleeve 14 has a knurled portion 16 which can advantageously be an intermediate portion along the length L of the sleeve 14.

If used, the knurled portion 16 can have straight knurling. Alternatively, the knurled portion 16 can have criss-cross knurling, as shown in FIG. 2.

Alternatively, the outside surface of the sleeve 14 can have a smooth cylindrical portion 16 with tolerances assuring a tight fit. For example, good results are obtained with an orifice having a diameter of $9_{-0}^{+0.09}$ mm and a sleeve 14 having a diameter of $9.11_{-0}^{-0.04}$ mm.

A further alternative is for the outside surface portion 16 of the sleeve 14 to have an excrescence formed by longitudinal or circular deformation.

In all cases, it can be advantageous to provide at the base of the outside surface of the sleeve 14 an annular groove 22 which limits the length of the sleeve outside surface portion 16 interengaged with the wall of the fluid feed orifice 15.

Accordingly, in accordance with the invention, the spray nozzle body 7 has no other means for fixing the spray nozzle into the cylinder wall 2 and for preventing it rotating about its axis. These two functions of fixing and rotation prevention are assured by the sleeve 14 force-fitted into the fluid feed orifice 15 of the cylinder wall 2.

The fitting of the sleeve 14 into the fluid feed orifice 15 and its guidance by the locating abutments 20 and 21 locate the spray nozzle with greater precision, because there is no clearance between the sleeve 14 and the fluid feed orifice 15 and because the guidance is the same during the two operations of final shaping of the conduit 10 and of insertion of the spray nozzle 1 into the engine.

The end of the sleeve 14 has a conical chamfer 17 adapted to facilitate insertion into the fluid feed orifice 15, limiting the risk of damage to the wall of the fluid feed orifice 15 and facilitating fitting.

The presence of the force-fitted part 16 renders the assembly of the spray nozzle into the crankcase 2 particularly rigid from the mechanical point of view, while providing sufficient seal to prevent the cooling fluid escaping between the sleeve 14 and the fluid feed orifice 15.

An internal combustion engine can therefore advantageously include cooling spray nozzles 1 of the invention, as described previously, fixed into the piston chamber or chambers and each adapted to spray a concentrated jet of the cooling fluid onto the back 4 of a piston 5.

The present invention is not limited to the embodiment explicitly described, but includes variants and generalizations thereof within the scope of the following claims.

There is claimed:

1. A spray nozzle for cooling internal combustion engine pistons, comprising a spray nozzle body with an axial passage through it communicating with a transverse bore connected to a cooling fluid outlet injection conduit, said spray nozzle body being shaped so that it can be fixed to the cylinder wall and establish sealed communication between said axial passage and a fluid feed orifice for introducing said cooling fluid into said spray nozzle, with centering and rotation preventing means for positioning said spray nozzle body in a cylinder of the engine, wherein:

said spray nozzle body comprises a sleeve in the shape of a cylinder of revolution coaxial with said axial passage, the outside diameter of said sleeve being such that it can be force-fitted into said fluid feed orifice which is itself a cylinder of revolution, and said cooling fluid outlet injection conduit has two opposed lateral reference faces shaped to constitute reference faces that can cooperate with locating abutments both during bending of said conduit and during fitting of said spray nozzle into said engine.

2. The cooling spray nozzle claimed in claim 1 wherein an outside surface of said sleeve has a knurled portion with straight knurling.

3. The cooling spray nozzle claimed in claim 1 wherein an outside surface of said sleeve has a knurled portion with criss-cross knurling.

4. The cooling spray nozzle claimed in claim 1 wherein an outside surface of said sleeve has a smooth cylindrical portion with tolerances enabling a tight fit.

5. The cooling spray nozzle claimed in claim 1 wherein an outside surface of said sleeve has at its base an annular groove limiting the length of said sleeve interengaged with a wall of said fluid inlet orifice.

6. An internal combustion engine comprising cooling spray nozzles as claimed in claim 1 fixed into the piston chamber or chambers and each adapted to spray a concentrated jet of cooling fluid onto the back of a piston.

* * * * *